US011297894B1

(12) United States Patent
Yang et al.

(10) Patent No.: US 11,297,894 B1
(45) Date of Patent: Apr. 12, 2022

(54) FUNCTIONAL SHOE INSOLE

(71) Applicants: Sungmo Yang, Gimpo-si (KR); Heejun Yang, Gimpo-si (KR)

(72) Inventors: Sungmo Yang, Gimpo-si (KR); Heejun Yang, Gimpo-si (KR)

( * ) Notice: Subject to any disclaimer, the term of this patent is extended or adjusted under 35 U.S.C. 154(b) by 0 days.

(21) Appl. No.: 17/483,137

(22) Filed: Sep. 23, 2021

(30) Foreign Application Priority Data

Dec. 17, 2020 (KR) ..... 10-2020-0177143

(51) Int. Cl.
*A43B 7/14* (2022.01)
*A43B 7/1455* (2022.01)
*A61H 39/04* (2006.01)

(52) U.S. Cl.
CPC ..... *A43B 7/146* (2013.01); *A61H 39/04* (2013.01); *A61H 2201/165* (2013.01); *A61H 2205/125* (2013.01)

(58) Field of Classification Search
CPC .. A43B 7/146; A61H 39/04; A61H 2201/165; A61H 2205/125; A61H 2201/1695; A61H 2201/164; A61H 2205/12
See application file for complete search history.

(56) References Cited

U.S. PATENT DOCUMENTS 4,694,831 A * 9/1987 Seltzer ..... A43B 7/00 15/227
2013/0199056 A1* 8/2013 Lim ..... A43B 7/1485 36/43
2018/0008002 A1* 1/2018 Yick ..... A43B 7/14
2018/0140041 A1* 5/2018 Comstock ..... A43B 7/146

FOREIGN PATENT DOCUMENTS

KR 10-0935579 B1 1/2010
KR 10-2015-0011455 A 2/2015
KR 10-2020-0044436 A 4/2020

* cited by examiner

*Primary Examiner* — Quang D Thanh
(74) *Attorney, Agent, or Firm* — United One Law Group LLC; Kongsik Kim; Jhongwoo Peck

(57) ABSTRACT

A functional shoe insole includes: a body part located inside a shoe, and configured to, when the shoe is worn by a user, come into direct contact with a sole of a foot of the user and distribute a load applied to the foot; an arch stimulation member coupled to the body part at a predetermined position, and configured to stimulate an arch portion of the sole of the foot of the user; and a heel stimulation member coupled to the body part at a predetermined position, and configured to stimulate a heel portion of the sole of the foot of the user. The arch stimulation member includes a first arch acupressure module. The heel stimulation member includes a first heel acupressure module.

11 Claims, 8 Drawing Sheets

FUNCTIONAL SHOE INSOLE

CROSS-REFERENCE TO RELATED APPLICATION

This application claims priority to Korean Patent Application No. 10-2020-0177143 filed on Dec. 17, 2020, which application is incorporated herein by reference in its entirety.

BACKGROUND

1. Technical Field

The present disclosure relates generally to a functional shoe insole, and more particularly to a functional shoe insole in which stimulation members are coupled to an insole such that they are positioned under the arch and heel portions of a foot, so that the arch and heel portions of the foot can be efficiently stimulated whenever a user walks.

2. Description of the Related Art

Generally, the feet are the parts of the body that need to move most flexibly in our body. Foot disease is also emerging as a serious medical problem. The feet act as a pump that pumps blood to the heart under pressure every time a person walks, so that they are important parts to such an extent as to be called a second heart. A foot symptom is dangerous in that it does not only cause pain in the foot, but can also cause pain in any part of the body, such as the leg, a bone, the spine, or the shoulder joint.

Furthermore, all organs of the human body are connected to the soles of the feet. The health of the feet, which can be said to be a microcosm of the human body, is closely related to the health of the overall human body, and thus shoes with functions corresponding to the health of people today are required.

Since the bottoms of shoes are flat, they cannot distribute a user's weight when the user steps on the ground, and thus the pressure transferred to the feet is high, so that there is a problem in that a herniated disk and degenerative arthritis are caused due to the burden on the spine and the deterioration of the knee joints.

The so-called health shoes that were developed to solve these shortcomings are configured such that the bottoms of the outsoles thereof are formed in a streamlined shape. Each of the shoes is designed to move forward as if it rolls along the streamline of the bottom thereof when a wearer steps forward to start with the heel of the shoe during walking.

Furthermore, Korean Patent Application Publication No. 10-2012-38190 discloses health shoes for maintaining the balance of the human body and the feet. Each of the health shoes for maintaining the balance of the human body and the feet includes: a cylindrical arch support accommodating part configured to be formed in the midsole of a shoe and including a forefoot portion, an arch portion, and a heel portion; a support housing configured to be fitted and fixed into the arch support accommodation part and having a spiral formed therein; an elastic coil spring configured to be inserted into the support housing; a foot arch support having a head integrated with the upper end thereof and configured to be inserted into the support housing with the upper portion of the elastic coil spring inserted thereinto and to be displaced up and down; and a foot arch support cover configured to be fitted into a cover accommodation groove formed in the midsole along the outer periphery of the accommodation part and to cover the foot arch support. Accordingly, the feet of a shoe wearer are maintained in a balanced state by the elastic spring constituting the arch support, and thus the human body is balanced during walking, so that there is no secondary distortion of the shoulder, the waist, and the neck and the fatigue caused by walking can be significantly reduced. They are worn by people whose arches, which are the arch parts of the feet, have already collapsed or are out of balance, and thus enable the correction and recovery of the deformed feet. Furthermore, the structure of the foot arch support is simple, and thus it can be easily installed on the sole of the shoe and also the cost of the installation thereof is reduced, so that the shoes have excellent economic feasibility that can lower the price of products. Moreover, the shoes can be used for a long time without damage to the arch support and thus have a special advantage of long lifespan.

However, the elasticity of the support is maintained by the coil spring in the foot arch support accommodation part by forming the foot arch support accommodation part in the midsole. In order to accommodate the coil spring and take into consideration an elastic repulsion distance, the depth of the arch support accommodation part must be deep, so that they cannot be applied to shoes with a thin midsole. Furthermore, an excessive number of accessories, such as the foot arch support accommodation part, the support housing, the elastic coil spring, the foot arch support, and the foot arch support cover, must be provided. Moreover, there is a problem in that the height and the like cannot be adjusted after coupling, so that they cannot deal with various foot shapes of users.

RELATED ART DOCUMENTS

Patent document 1: KR1020120038190 A
Patent document 2: KR101751795 B1
Patent document 3: KR101731167 B1
Patent document 4: KR101748186 B1

SUMMARY

A functional shoe insole according to an embodiment of the present disclosure has been conceived to overcome the above-described problems, and an object of the present invention is to provide a functional shoe insole that can continuously stimulate the arch and heel portions of the sole of a foot of a user during walking through stimulation members and can adjust the intensities and heights of the stimulation members according to the shape of the foot of the user.

According to an aspect of the present invention, there is provided a functional shoe insole including: a body part located inside a shoe, and configured to, when the shoe is worn by a user, come into direct contact with the sole of a foot of the user and distribute a load applied to the foot; an arch stimulation member coupled to the body part at a predetermined position, and configured to stimulate the arch portion of the sole of the foot of the user; and a heel stimulation member coupled to the body part at a predetermined position, and configured to stimulate the heel portion of the sole of the foot of the user; wherein the arch stimulation member includes a first arch acupressure module that is fixedly coupled to the bottom surface of the body part and forms an upward curve on the top surface of the body part; wherein the first arch acupressure module includes a first frame provided with rectangular edges having a predetermined thickness, and a second frame coupled in a form rising upward from opposite edges of the first frame toward the center of the first frame and configured to form an arch-shaped space; wherein the second frame includes a circular unit disposed at the center of the second frame, and a pair of coupling units configured to connect the circular unit and the edges of the first frame; wherein the coupling units are formed to become narrower in width in directions from the edges to the circular unit and include at least one through hole, and the area of the through hole is 20 to 40% of the area of the top surfaces of the coupling units; wherein the heel stimulation member includes a first heel acupressure module that is fixedly coupled to the bottom surface of the body part and forms an upward curve on the top surface of the body part; wherein the first heel acupressure module includes a first frame provided with rectangular edges having a predetermined thickness, and a second frame coupled in a form rising upward from opposite edges of this first frame toward the center of this first frame and configured to form an arch-shaped space; and wherein this second frame is formed to become narrower in width in a direction from one of these opposite edges to the center of the distance between these opposite edges and then to become wider in a direction from the center of the distance to the remaining one of these opposite edges, and at least one cushion protrusion is provided on the top surface of this second frame.

The arch stimulation member may further include a second arch acupressure module that is coupled to the first arch acupressure module and supports the first arch acupressure module; and the second arch acupressure module may be formed in a shape corresponding to the bottom surface of the second frame of the first arch acupressure module, and, when the second arch acupressure module is coupled to the first arch acupressure module, may be contained in the arch-shaped space formed by the first arch acupressure module and be positioned under the second frame of the first arch acupressure module, thereby forming another arch-shaped shape.

The arch stimulation member may further include a third arch acupressure module that is coupled to the first arch acupressure module and changes the height of the curve on the top surface of the body part; the third arch acupressure module may include a first frame provided with rectangular edges having a predetermined thickness, and a second frame coupled in a form rising upward from opposite edges of this first frame toward the center of this first frame and configured to form an arch-shaped space; this second frame may include a circular unit disposed at the center of this second frame, and a pair of coupling units configured to connect this circular unit and the edges of this first frame; and these coupling units may be formed to become narrower in width in directions from these edges to this circular unit.

The first arch acupressure module, the second arch acupressure module, and the third arch acupressure module may be made of a polyester-based synthetic resin material, a synthetic rubber material of baritone rubber, or an elastic material of elastic fiber, and may be elastically deformable according to an elastic modulus, which is the designed ratio of stress to strain.

The heel stimulation member may further include a second heel acupressure module that is coupled to the first heel acupressure module and supports the first heel acupressure module; and the second heel acupressure module may be formed in a shape corresponding to the bottom surface of the second frame of the first heel acupressure module, and, when the second heel acupressure module is coupled to the first heel acupressure module, may be contained in the arch-shaped space formed by the first heel acupressure module and be positioned under the second frame of the first heel acupressure module, thereby forming another arch-shaped space.

The heel stimulation member may further include a third heel acupressure module that is coupled to the first heel acupressure module and changes the height of the curve on the top surface of the body part; the third heel acupressure module may include a first frame provided with rectangular edges having a predetermined thickness, and a second frame coupled in a form rising upward from opposite edges of this first frame toward the center of this first frame and configured to form an arch-shaped space; and the second frame may be formed to become narrower in width in a direction from one of these opposite edges to the center of the distance between these opposite edges and then to become wider in a direction from the center of the distance to the remaining one of these opposite edges.

The first heel acupressure module, the second heel acupressure module, and the third heel acupressure module may be made of a polyester-based synthetic resin material, a synthetic rubber material of baritone rubber, or an elastic material of elastic fiber, and may be elastically deformable according to an elastic modulus, which is the designed ratio of stress to strain.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

Figure 1:
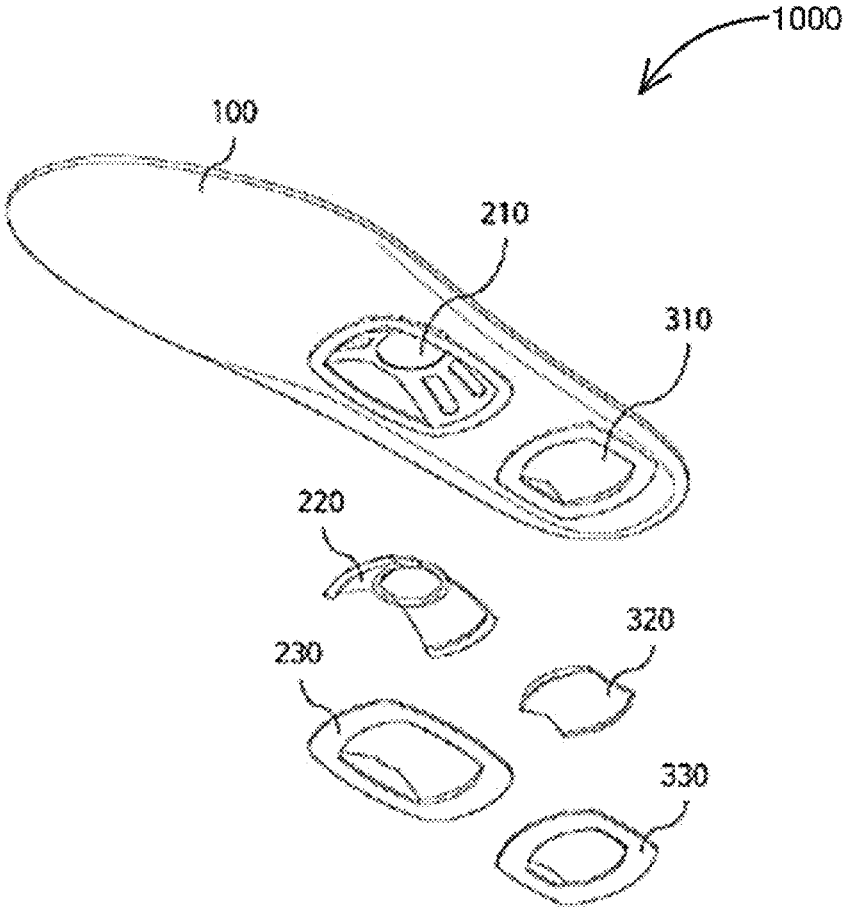
FIGS. 1 and 2 are views showing the configuration of a functional shoe insole according to the present disclosure.

The technical spirit of the present invention will be described below with reference to the accompanying drawings, which is intended for easier understanding. However, the scope of the present invention is not limited thereto, and the present invention is defined only by the scope of the attached claims.

In the following description of embodiments of the present invention, when it is determined that a detailed description of a known function or configuration may unnecessarily obscure the gist of the present invention, the detailed description will be omitted. Throughout the present specification, like reference numerals designate like components.

Figure 2:
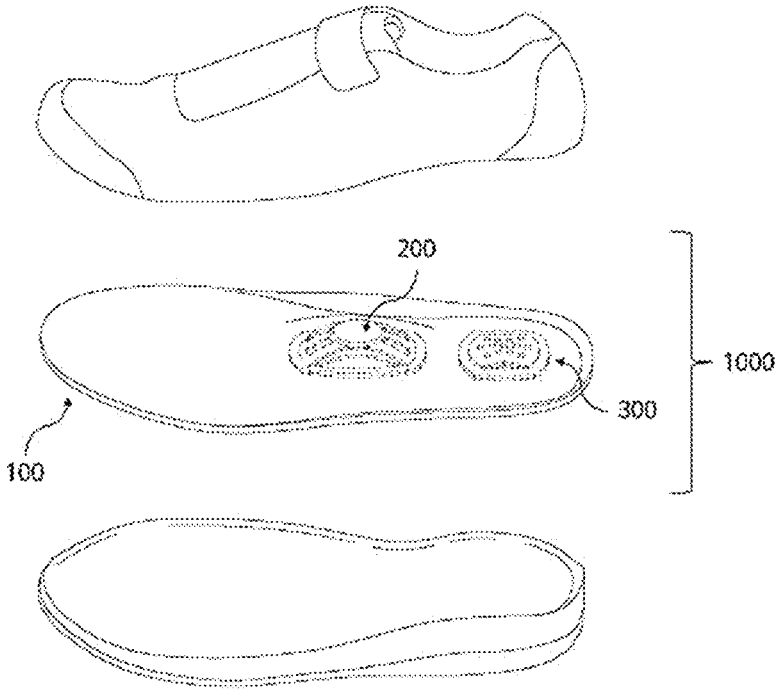
Figure 3:
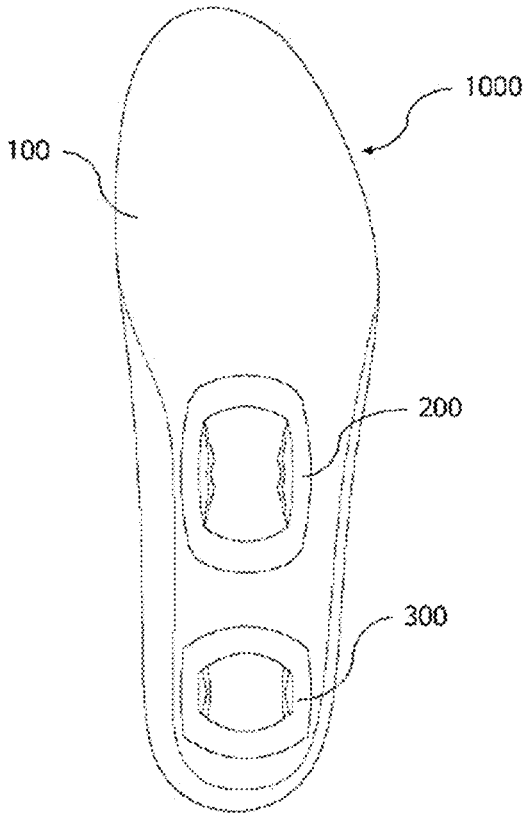
FIG. 3 is a view showing the bottom surface of the functional shoe insole according to the present disclosure.
Figure 4:
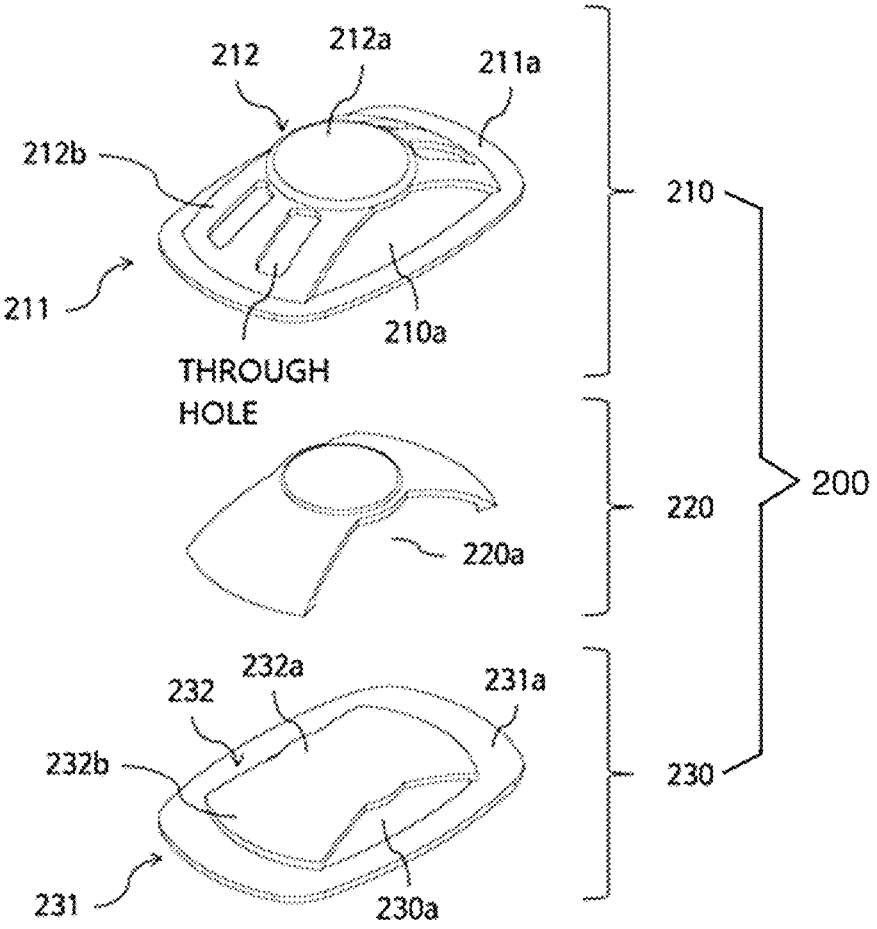
FIG. 4 is a view showing the configuration of an arch stimulation member according to the present disclosure.
Figure 5:
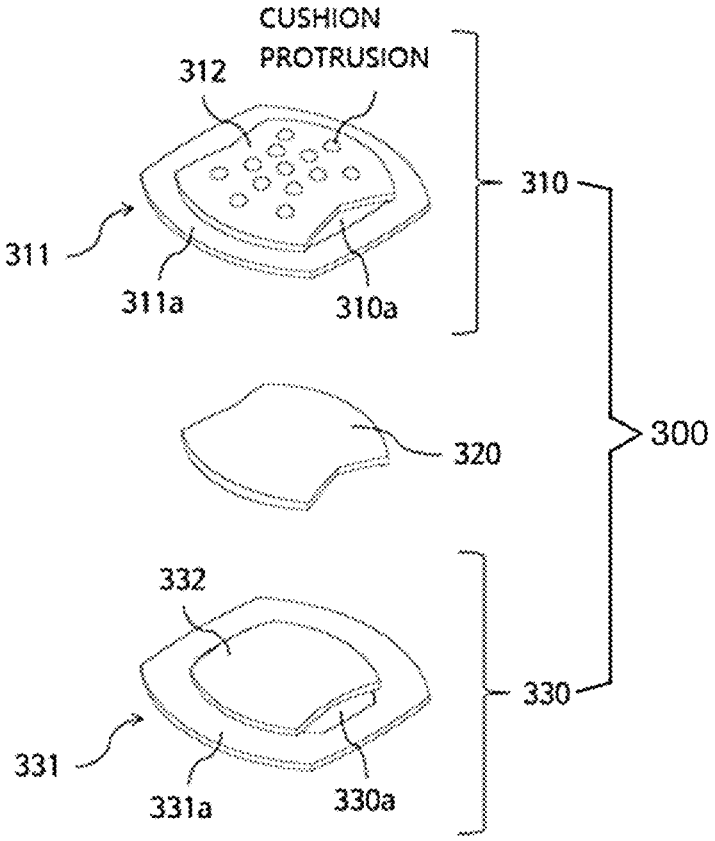
FIG. 5 is a view showing the configuration of a heel stimulation member according to the present disclosure.
Figure 6:
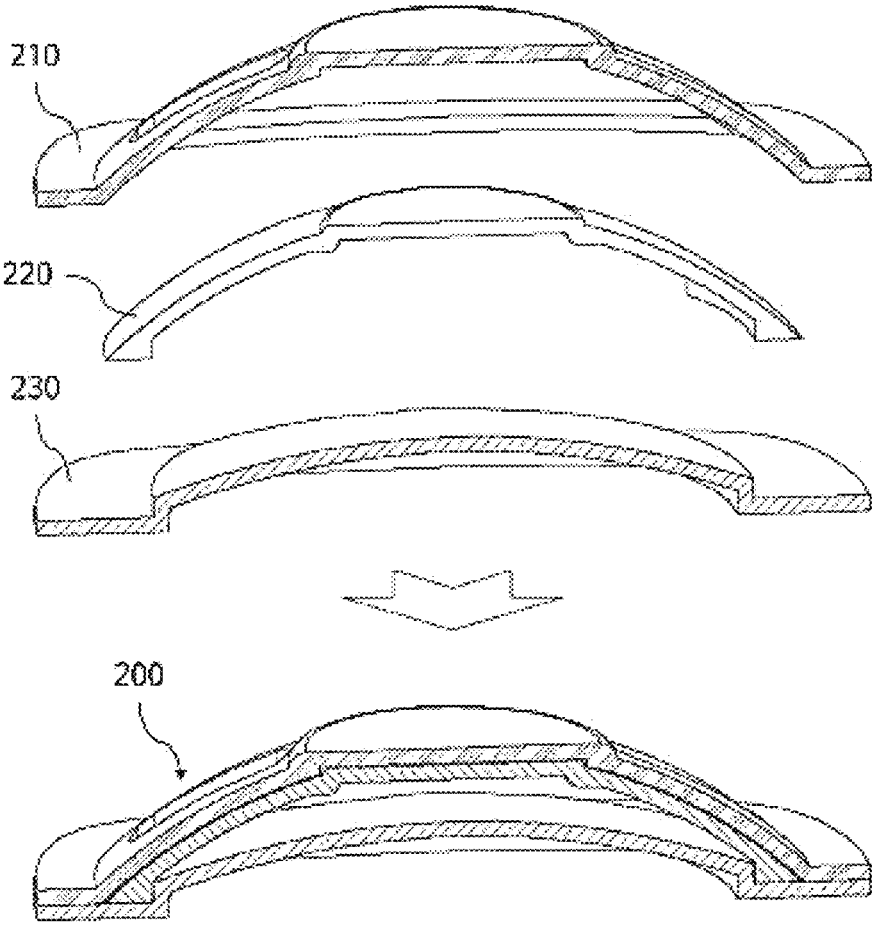
FIG. 6 is a view illustrating in detail the arch stimulation member according to the present disclosure.
Figure 7:
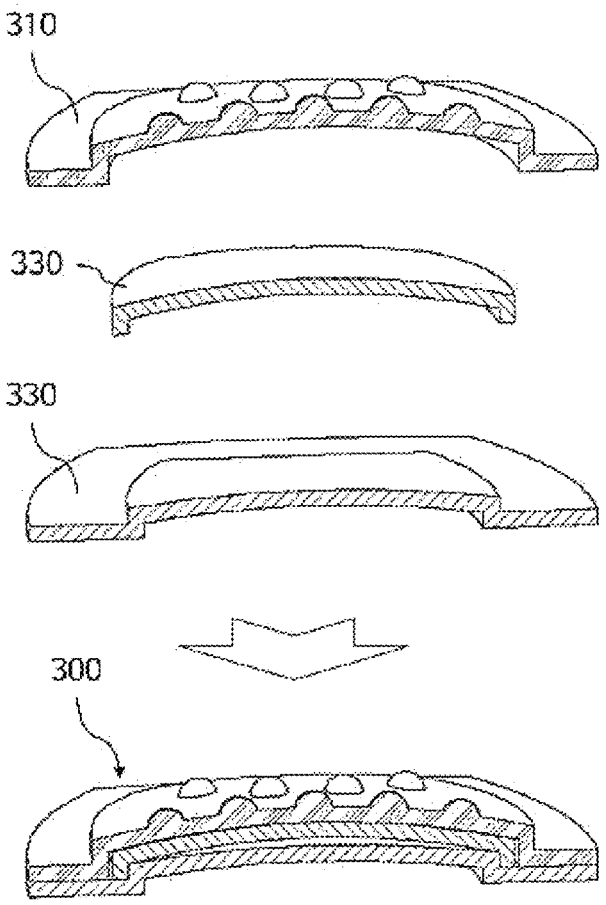
FIG. 7 is a view illustrating in detail the heel stimulation member according to the present disclosure.
Figure 8:
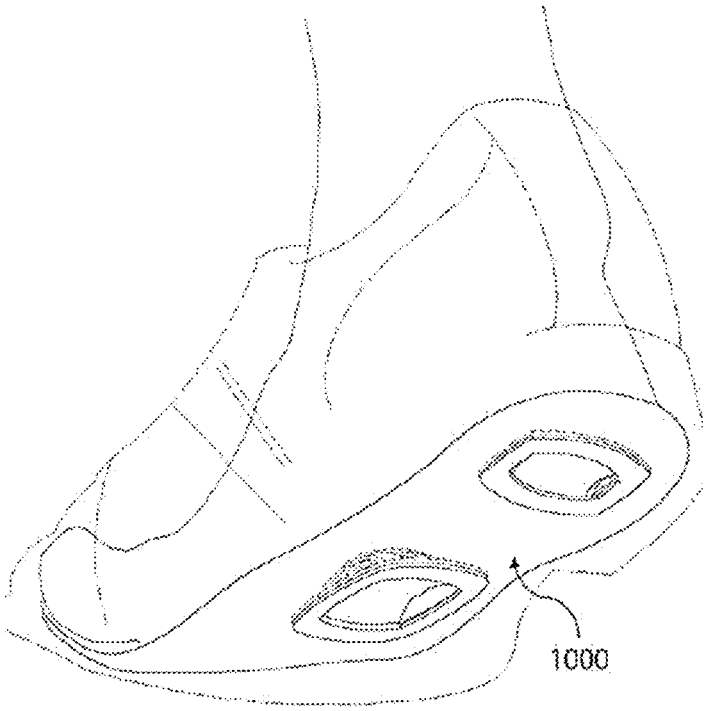
FIG. 8 is a view showing an embodiment of a functional shoe insole according to the present disclosure.

FIGS. 1 and 2 are views showing the configuration of a functional shoe insole according to the present disclosure, FIG. 3 is a view showing the bottom surface of the functional shoe insole according to the present disclosure, FIG. 4 is a view showing the configuration of an arch stimulation member according to the present disclosure, FIG. 5 is a view showing the configuration of a heel stimulation member according to the present disclosure, FIG. 6 is a view illustrating in detail the arch stimulation member according to the present disclosure, FIG. 7 is a view illustrating in detail the heel stimulation member according to the present disclosure, and FIG. 8 is a view showing an embodiment of a functional shoe insole according to the present disclosure.

Functional Shoe Insole According to an Embodiment of the Present Disclosure

Referring to FIGS. 1 to 5, a functional shoe insole 1000 according to an embodiment of the present disclosure may include a body part 100, an arch stimulation member 200, and a heel stimulation member 300.

The body part 100 is located inside a shoe, and, when the shoe is worn by a user, comes into direct contact with the sole of the user and distributes a load applied to a foot of the user. As shown in FIGS. 1 to 3, the bottom surface of the body part 100 may be provided with coupling depressions configured to be coupled with the arch stimulation member 200 and the heel stimulation member 300, which will be described later.

Specifically, referring to FIG. 3, the arch stimulation member 200 is preferably provided with the coupling depression so that coupling is achieved in the state in which the length thereof in a vertical direction is longer than the length thereof in a lateral direction and the heel stimulation member 300 is preferably provided with the coupling depression so that coupling is achieved in the state in which the length thereof in a lateral direction is longer than the length thereof in a vertical direction. The configuration is not necessarily limited thereto. It is obvious that it may be provided in various manners as needed.

Referring to FIGS. 1 and 4, the arch stimulation member 200 is coupled to the body part 100 at a predetermined position and intended to stimulate the arch portion of the sole of a foot of a user. The arch stimulation member 200 may be configured to include a first arch acupressure module 210.

The first arch acupressure module 210 may be fixedly coupled to the bottom surface of the body part 100 and configured to form an upward curve on the top surface of the body part 100.

As shown in FIG. 4, the first arch acupressure module 210 may be configured to include a first frame 211 provided with rectangular edges 211*a* having a predetermined thickness, and a second frame 212 coupled in a form rising upward from opposite edges 211*a* of the first frame 211 toward the center of the first frame 211 and adapted to form an arch-shaped space 210*a*.

The second frame 212 may be configured to include a circular unit 212*a* disposed at the center of the second frame 212, and a pair of coupling units 212*b* adapted to connect the circular unit 212*a* and the edges 211*a* of the first frame 211.

The circular unit 212*a* may be configured to protrude upward above the coupling units 212*b*, and the coupling units 212*b* may be formed to become narrower in width in directions from the edges 211*a* to the circular unit 212*a* and include at least one through hole.

Although a total of four through holes having a rectangular shape are shown as being provided with two through holes on each of the left and right sides in FIG. 4, the configuration is not necessarily limited thereto. It is obvious that it may be provided in various shapes and in various numbers as needed.

Since the through holes are provided in the coupling units 212*b*, there is an advantage in that the second frame 212 can easily move in a vertical direction even when a load is applied in an oblique direction as well as in a direction perpendicular to the second frame 212 during the walking of a user.

Meanwhile, as a result obtained through repeated experiments, when the top area of the coupling units 212*b* is set to 100%, the area of the through holes is preferably 20 to 40%, and the area of the through holes is preferably formed to be symmetrical with respect to a straight line equally dividing the opposite edges 212*a*. The reason for this is that when the area of the through holes is smaller than 20%, the radius of the movement of the first arch module 210 is limited, and thus the first arch module 210 may be damaged by the load of a user, and when the area of the through holes is larger than 40%, the elastic force by the first arch module 210 decreases, and thus the effect of stimulation may be reduced.

As shown in FIGS. 1 and 4, the arch stimulation member 200 may be configured to further include a second arch acupressure module 220 that is coupled to the first arch acupressure module 210 and supports the first arch acupressure module 210.

Referring to FIGS. 1, 4 and 6, the second arch acupressure module 220 may be formed in a shape corresponding to the bottom surface of the second frame 212. When the second arch acupressure module 220 is coupled to the first arch acupressure module 210, it is contained in the arch-shaped space 210*a* formed by the first arch acupressure module 210 and is positioned under the second frame 212, thereby forming another arch-shaped shape 220*a*.

Since the second arch acupressure module 220 is coupled to the first arch acupressure module 210, the radius of the vertical movement of the first arch acupressure module 210 is limited during walking, so that there is provided the effect of increasing the intensity at which the arch portion of a foot of a user is stimulated. Meanwhile, it is preferable that the second arch acupressure module 220 is detachably coupled to the first arch acupressure module 210, and accordingly the user may adjust the intensity at which the arch portion is stimulated according to the shape of his or her foot.

As shown in FIGS. 1 and 4, the arch stimulation member 200 may be configured to further include a third arch acupressure module 230 that is coupled to the first arch acupressure module 210 and changes the height of the curve on the top surface of the body part 100.

Referring to FIG. 4, the third arch acupressure module 230 may be configured to include a first frame 231 provided with rectangular edges 231*a* having a predetermined thickness, and a second frame 232 coupled in a form rising upward from opposite edges 231*a* of the first frame 231 toward the center of the first frame 231 and adapted to form an arch-shaped space 230*a*.

The second frame 232 may be configured to include a circular unit 232*a* disposed at the center of the second frame 232, and a pair of coupling units 232*b* adapted to connect the circular unit 232*a* and the edges 231*a* of the first frame 231. The coupling units 232*b* may be formed to become narrower in width in directions from the edges 231*a* to the circular unit 232*a*.

Since the third arch acupressure module 230 is coupled to the first arch acupressure module 210, the height of the curve on the top surface of the body part 100 may be increased, so that there is provided the effect of adjusting the height according to the shape of the foot of the user. Meanwhile, it is preferable that the third arch acupressure module 230 is detachably coupled to the first arch acupressure module 210.

Furthermore, coupling means capable of protrusion-depression coupling may be provided on the top surface of the first frame 231 of the third arch acupressure module 230 and the bottom surface of the first frame 211 of the first arch acupressure module 210. Accordingly, when the third arch acupressure module 230 is coupled to the first arch acupressure module 210, there may be provided the effect in which the position of the third arch acupressure module 230 may be fixed not to be easily separated from the first arch acupressure module 210.

Meanwhile, it is preferable that the first arch acupressure module 210, the second arch acupressure module 220, and the third arch acupressure module 230 are made of a polyester-based synthetic resin material, a synthetic rubber material of baritone rubber, or an elastic material of elastic fiber and are configured to be elastically deformable according to an elastic modulus, which is the designed ratio of stress to strain. The configuration is not necessarily limited thereto. It is obvious that it may be configured in various manners as needed.

Referring to FIGS. 1 and 5, the heel stimulation member 300 is coupled to the body part 100 at a predetermined position and intended to stimulate the heel portion of a foot of a user. The heel stimulation member 300 may be configured to include a first heel acupressure module 310.

The first heel acupressure module 310 may be configured to include a first frame 311 provided with rectangular edges 311*a* having a predetermined thickness, and a second frame 312 coupled in a form rising upward from opposite edges 311*a* of the first frame 311 toward the center of the first frame 311 and adapted to form an arch-shaped space 310*a*.

The second frame 312 may be formed to become narrower in width in a direction from one of the opposite edges 311*a* to the center of the distance between the opposite edges 311*a* and then to become wider in a direction from the center of the distance to the other edge 311*a*. At least one cushion protrusion may be provided on the top surface of the second frame 312. Since the cushion protrusion is formed, the heel portion of the user may be continuously subjected to acupressure by the cushion protrusion during walking, thereby helping blood circulation.

As shown in FIGS. 1 and 5, the heel stimulation member 300 may be configured to further include a second heel acupressure module 320 that is coupled to the first heel acupressure module 310 and supports the first heel acupressure module 310.

Referring to FIGS. 1, 5, and 7, the second heel acupressure module 320 may be formed in a shape corresponding to the bottom surface of the second frame 312. When the second heel acupressure module 320 is coupled to the first heel acupressure module 310, it is contained in the arch-shaped space 310*a* formed by the first heel acupressure module 310 and is positioned under the second frame 312, thereby forming another arch-shaped space 320*a*.

Since the second heel acupressure module 320 is coupled to the first heel acupressure module 310, the radius of the vertical motion of the first heel acupressure module 310 is limited during walking, so that there may be provided the effect of increasing the intensity at which the heel portion of the foot of the user is stimulated. Meanwhile, it is preferable that the second heel acupressure module 320 is detachably coupled to the first heel acupressure module 310, and accordingly the user may adjust the intensity at which the heel portion is stimulated according to the shape of his or her foot.

As shown in FIGS. 1 and 5, the heel stimulation member 300 may be configured to further include a third heel acupressure module 330 that is coupled to the first heel acupressure module 310 and changes the height of the curve on the top surface of the body part 100.

Referring to FIG. 5, the third heel acupressure module 330 may be configured to include a first frame 331 provided with rectangular edges 331*a* having a predetermined thickness, and a second frame 332 coupled in a form rising upward from opposite edges 331*a* of the first frame 331 toward the center of the first frame 331 and adapted to form an arch-shaped space 330*a*.

The second frame 332 may be formed to become narrower in width in a direction from one of the opposite edges 331*a* to the center of the distance between the opposite edges 331*a* and then to become wider in a direction from the center of the distance to the other edge 331*a*.

Since the third heel acupressure module 330 is coupled to the first heel acupressure module 310, the height of the curve on the top surface of the body part 100 may be increased, so that there may be provided the effect of adjusting the height according to the shape of the foot of the user. Meanwhile, it is preferable that the third heel acupressure module 330 is detachably coupled to the first heel acupressure module 310.

Furthermore, coupling means capable of protrusion-depression coupling may be provided on the top surface of the first frame 331 of the third heel acupressure module 330 and the bottom surface of the first frame 311 of the first heel acupressure module 310. Accordingly, when the third heel acupressure module 330 is coupled to the first heel acupressure module 310, there may be provided the effect in which the position of the third heel acupressure module 330 may be fixed not to be easily separated from the first heel acupressure module 310.

Meanwhile, it is preferable that the first heel acupressure module 310, the second heel acupressure module 320, and the third heel acupressure module 330 are made of a polyester-based synthetic resin material, a synthetic rubber material of baritone rubber, or an elastic material of elastic fiber and are configured to be elastically deformable according to an elastic modulus, which is the designed ratio of stress to strain. The configuration is not necessarily limited thereto. It is obvious that it may be configured in various manners as needed.

The functional shoe insole according to the embodiment of the present disclosure has advantages in that the arch and heel portions of the sole of the foot of the user can be continuously stimulated during walking through the stimulation members and the intensities and heights of the stimulation members can be adjusted according to the shape of the foot of the user.

Meanwhile, although the functional shoe insole according to the embodiment of the present disclosure has been described in conjunction with sports shoes shown in FIG. 8, it is not limited thereto. It is obvious that the functional shoe insole according to the present disclosure may be applied to various types of footwear such as indoor shoes, slippers, and shoes.

While the foregoing description has been given with reference to the accompanying drawings according to the embodiments of the present disclosure, it may be possible for those of ordinary skill in the art to make various applications, modifications and adaptations within the scope of the present invention based on the content of the foregoing description.

What is claimed is:

1. A functional shoe insole comprising:

a body part located inside a shoe, and configured to, when the shoe is worn by a user, come into direct contact with a sole of a foot of the user and distribute a load applied to the foot;

an arch stimulation member coupled to the body part at a predetermined position, and configured to stimulate an arch portion of the sole of the foot of the user; and a heel stimulation member coupled to the body part at a predetermined position, and configured to stimulate a heel portion of the sole of the foot of the user, wherein the arch stimulation member includes a first arch acupressure module that is fixedly coupled to a bottom surface of the body part and forms an upward curve on a top surface of the body part, wherein the first arch acupressure module includes a first frame provided with rectangular edges having a predetermined thickness, and a second frame coupled in a form rising upward from opposite edges of the first frame toward a center of the first frame and configured to form an arch-shaped space, wherein the second frame includes a circular unit disposed at a center of the second frame, and a pair of coupling units configured to connect the circular unit and the edges of the first frame, wherein the coupling units are formed to become narrower in width in directions from the edges of the first frame to the circular unit and include at least one through hole, and an area of the through hole is 20 to 40% of an area of top surfaces of the coupling units, wherein the heel stimulation member includes a first heel acupressure module that is fixedly coupled to the bottom surface of the body part and forms an upward curve on the top surface of the body part, wherein the first heel acupressure module includes a third frame provided with rectangular edges having a predetermined thickness, and a fourth frame coupled in a form rising upward from opposite edges of the third frame toward a center of the third frame and configured to form an arch-shaped space, and wherein the fourth frame is formed to become narrower in width in a direction from one of the opposite edges of the third frame to a center of a distance between the opposite edges of the third frame and then to become wider in a direction from the center of the distance to a remaining one of the opposite edges of the third frame, and at least one cushion protrusion is provided on a top surface of the fourth frame.

2. The functional shoe insole of claim 1, wherein the arch stimulation member further includes a second arch acupressure module that is coupled to the first arch acupressure module and supports the first arch acupressure module, and wherein the second arch acupressure module is formed in a shape corresponding to a bottom surface of the second frame of the first arch acupressure module, and, when the second arch acupressure module is coupled to the first arch acupressure module, the second arch acupressure module is contained in the arch-shaped space formed by the first arch acupressure module and is positioned under the second frame of the first arch acupressure module, thereby forming another arch-shaped space.

3. The functional shoe insole of claim 1, wherein the arch stimulation member further includes a second arch acupressure module that is coupled to the first arch acupressure module and changes a height of the upward curve on the top surface of the body part, wherein the second arch acupressure module includes a fifth frame provided with rectangular edges having a predetermined thickness, and a sixth frame coupled in a form rising upward from opposite edges of the fifth frame toward a center of the fifth frame and configured to form an arch-shaped space, wherein the sixth frame includes a circular unit disposed at a center of the sixth frame, and a pair of coupling units configured to connect the circular unit and the edges of the fifth frame, and wherein the coupling units are formed to become narrower in width in directions from the edges of the fifth frame to the circular unit.

4. The functional shoe insole of claim 3, wherein the first arch acupressure module and the second arch acupressure module are made of a polyester-based synthetic resin material, a synthetic rubber material of baritone rubber, or an elastic material of elastic fiber, and are elastically deformable according to an elastic modulus, which is a designed ratio of stress to strain.

5. The functional shoe insole of claim 2, wherein the arch stimulation member further includes a third arch acupressure module that is coupled to the first arch acupressure module and changes a height of the upward curve on the top surface of the body part, wherein the third arch acupressure module includes a fifth frame provided with rectangular edges having a predetermined thickness, and a sixth frame coupled in a form rising upward from opposite edges of the fifth frame toward a center of the fifth frame and configured to form an arch-shaped space, wherein the sixth frame includes a circular unit disposed at a center of the sixth frame, and a pair of coupling units configured to connect the circular unit and the edges of the fifth frame, and wherein the coupling units are formed to become narrower in width in directions from the edges of the fifth frame to the circular unit.

6. The functional shoe insole of claim 5, wherein the first arch acupressure module, the second arch acupressure module, and the third arch acupressure module are made of a polyester-based synthetic resin material, a synthetic rubber material of baritone rubber, or an elastic material of elastic fiber, and are elastically deformable according to an elastic modulus, which is a designed ratio of stress to strain.

7. The functional shoe insole of claim 1, wherein the heel stimulation member further includes a second heel acupressure module that is coupled to the first heel acupressure module and supports the first heel acupressure module, and wherein the second heel acupressure module is formed in a shape corresponding to a bottom surface of the fourth frame of the first heel acupressure module, and, when the second heel acupressure module is coupled to the first heel acupressure module, the second heel acupressure module is contained in the arch-shaped space formed by the first heel acupressure module and is positioned under the fourth frame of the first heel acupressure module, thereby forming another arch-shaped space.

8. The functional shoe insole of claim 1, wherein the heel stimulation member further includes a second heel acupressure module that is coupled to the first heel acupressure module and changes a height of the upward curve on the top surface of the body part, wherein the third heel acupressure module includes a fifth frame provided with rectangular edges having a predetermined thickness, and a sixth frame coupled in a form rising upward from opposite edges of the fifth frame toward a center of the fifth frame and configured to form an arch-shaped space, and wherein the sixth frame is formed to become narrower in width in a direction from one of the opposite edges of the fifth frame to a center of a distance between the opposite edges of the fifth frame and then to become wider in a direction from the center of the distance to a remaining one of the opposite edges of the fifth frame.

9. The functional shoe insole of claim 8, wherein the first heel acupressure module and the second heel acupressure module are made of a polyester-based synthetic resin material, a synthetic rubber material of baritone rubber, or an elastic material of elastic fiber, and are elastically deformable according to an elastic modulus, which is a designed ratio of stress to strain.

10. The functional shoe insole of claim 7, wherein the heel stimulation member further includes a third heel acupressure module that is coupled to the first heel acupressure module and changes a height of the upward curve on the top surface of the body part, wherein the third heel acupressure module includes a fifth frame provided with rectangular edges having a predetermined thickness, and a sixth frame coupled in a form rising upward from opposite edges of the fifth frame toward a center of the fifth frame and configured to form an arch-shaped space, and wherein the sixth frame is formed to become narrower in width in a direction from one of the opposite edges of the fifth frame to a center of a distance between the opposite edges of the fifth frame and then to become wider in a direction from the center of the distance to a remaining one of the opposite edges of the fifth frame.

11. The functional shoe insole of claim 10, wherein the first heel acupressure module, the second heel acupressure module, and the third heel acupressure module are made of a polyester-based synthetic resin material, a synthetic rubber material of baritone rubber, or an elastic material of elastic fiber, and are elastically deformable according to an elastic modulus, which is a designed ratio of stress to strain.

* * * * *